US006162169A

United States Patent [19]

Leysieffer

[11] Patent Number: 6,162,169

[45] Date of Patent: Dec. 19, 2000

[54] TRANSDUCER ARRANGEMENT FOR PARTIALLY OR FULLY IMPLANTABLE HEARING AIDS

[75] Inventor: Hans Leysieffer, Taufkirchen, Germany

[73] Assignee: IMPLEX Aktiengesellschaft Hearing Technology, Ismaning, Germany

[21] Appl. No.: 09/275,872

[22] Filed: Mar. 25, 1999

[30] Foreign Application Priority Data

Sep. 3, 1998 [DE] Germany ..... 198 40 212

[51] Int. Cl.[7] ..... H04R 25/00

[52] U.S. Cl. ..... 600/25

[58] Field of Search ..... 600/25, 559

[56] References Cited

U.S. PATENT DOCUMENTS

| | | | |
|---|---|---|---|
| 3,870,832 | 3/1975 | Fredrickson . | |
| 5,277,694 | 1/1994 | Leysieffer et al. . | |
| 5,282,858 | 2/1994 | Bisch et al. | 600/25 |
| 5,554,096 | 9/1996 | Ball . | |
| 5,558,618 | 9/1996 | Maniglia . | |
| 5,624,376 | 4/1997 | Ball et al. . | |
| 5,772,575 | 6/1998 | Lesinski et al. | 600/25 |

FOREIGN PATENT DOCUMENTS 42 21 866 1/1994 Germany .

*Primary Examiner*—Max Hindenburg
*Assistant Examiner*—Brian Szmal
*Attorney, Agent, or Firm*—Nixon Peabody LLP; David S. Safran

[57] ABSTRACT

The invention relates to a transducer for a partially or fully implantable hearing aids for direct mechanical excitation of the middle or inner ear. The transducer is provided with a housing fixedly mounted at the implantation site and a coupling element moveable with respect to the housing for transmitting vibration to the middle ear ossicle or directly to the inner ear. The housing accommodates an electromagnetic component such as a coil which is fixed relative to the housing and a vibratory component such as a permanent magnet which is mechanically connected to the coupling element such that the vibration of the vibratory component is transferred to the coupling element.

10 Claims, 2 Drawing Sheets

TRANSDUCER ARRANGEMENT FOR PARTIALLY OR FULLY IMPLANTABLE HEARING AIDS

BACKGROUND OF THE INVENTION

1. Field of the Invention

This invention relates to the field of transducers for partially or fully implantable hearing aids for direct mechanical excitation of the middle or inner ear. More specifically, this invention relates to such transducers including a housing which can be fixed at the implantation site with respect to the skull and a coupling element which can move with respect to the housing, the housing accommodating an electromechanical transducer by which the coupling element can transmit vibrations from the electromechanical transducer to the middle ear ossicle or directly to the inner ear.

2. Description of Related Art

A transducer arrangement of this general type is known from U.S. Pat. No. 5,277,694. In this reference, it is proposed that one wall of a housing be made as a vibrating membrane with an electromechanically active heteromorphic composite element with a piezoelectric ceramic disk attached to the side of the membrane inside the housing. Generally, a hearing aid transducer built in this manner can be implanted without difficulty and generally good results have been achieved. However, it has been found that at low frequencies, the coupling element driven by the piezoelectric ceramic disk does not create sufficient deflections to provide adequate loudness level for patients with medium and more serious hearing loss. This insufficient deflection has been attributed, in part, to be caused by the low electrical voltages required for such implants.

U.S. Pat. No. 5,624,376 discloses a transducer for partially or fully implantable hearing aids based on the electromagnetic principle in which a permanent magnet, together with two assigned pole pieces, is loosely suspended in a cylindrical housing. An induction coil which interacts with the permanent magnet is positioned in a cylindrical air gap bounded by the pole pieces and is permanently joined to one housing wall. When an AC voltage is applied to the coil, a grounded portion consisting of the permanent magnet and the pole pieces is vibrated. This grounded portion is mechanically coupled to the housing which is designed for attachment to a vibratory structure of the ear. Thus, when the grounded portion is vibrated, the resulting vibration of the housing stimulates the vibratory structure of the ear. However, it has been found that surgical implantation of such transducers is very difficult. Providing support for the housing and also mechanically coupling the housing with the vibratory structure of the ear (such as the ossicular chain) has been found to be especially difficult to surgically implement.

In an article by Fredrickson et al. entitled "Ongoing Investigations Into An Implantable Electromagnetic Hearing Aid for Moderate to Severe Sensorineural Loss", Otolaryngolic Clinics of North America, Vol. 28, No. 1, (February 1995), the authors mention an implantable middle ear transducer which drives a biocompatible probe tip and is accommodated in a hermetically sealed housing made of stainless steel. The probe tip fits into an opening on the incus which is formed by a laser beam. This reference, however, fails to disclose how the electromagnetic transducer is made or operated or how vibrations are transmitted from the electromagnetic transducer to the probe tip.

Therefore, there exists an unfulfilled need for electromagnetic transducers for partially or fully implantable hearing aids which provide direct mechanical excitation of the middle or inner ear while avoiding the surgical difficulties of the prior art transducers.

SUMMARY OF THE INVENTION

In view of the forgoing, the primary object of the present invention is to devise a hearing aid transducer which is mechanically coupled to a middle ear ossicle or directly to the inner ear for transmission of vibration.

A second object of the present invention is to devise a hearing aid transducer of the initially mentioned type which can generate even relatively low frequency vibrations with sufficient amplitude while using relatively little energy.

Yet another object of the present invention is to devise a hearing aid transducer which accomplishes the above objectives and may be surgically implanted without difficulty.

These objects are achieved by providing an electromechanical hearing aid transducer including an electromagnet arrangement with an electromagnetic component which is fixed relative to the housing and a vibratory component which is connected to the coupling element such that the vibrations of the vibratory component are transferred to the coupling element.

The present invention has advantages over the prior art hearing aid transducers in that the present transducer may be implanted easily without the problems associated with the piezoelectric transducer disclosed in U.S. Pat. No. 5,277,694 and be implanted with respect to a bony portion of the skull. In addition, by providing an electromagnetic transducer, the frequency response of the present transducer is improved especially at low frequencies of the hearing range so that adequate hearing loudness is achieved despite the low operating electrical voltages required in such implants.

More specifically, in one preferred embodiment, one wall of the housing may be made to vibrate and may be formed as a vibratory membrane with a vibratory component attached to the side of the membrane inside the housing and the coupling element connected to the side of the membrane outside the housing.

The housing is preferably made to be hermetically sealed and biocompatible. The preferred embodiment is advantageously made cylindrical and has one peripheral wall and two circular end walls which run essentially parallel to one another. One of the two circular end walls forms the vibratory membrane while the other circular end wall can be integrally joined to the peripheral wall of the housing.

Also in the preferred embodiment, both the vibratory component and also the coupling element are attached essentially at the center of the vibratory membrane. A vibratory component which may be a permanent magnet, is connected to the side of the membrane inside the housing. An electromagnetic element such as a coil is permanently attached within the housing and is operable to cause vibration of the permanent magnet.

In addition, the permanent magnet may be made as a magnetic pin and the electromagnetic component may be made as a ring coil with a center opening where the vibratory component such as the magnetic pin may be positioned. This yields a transducer with an especially small mass which is moved to create the vibration which promptly and accurately reflect changes in the electrical signal applied to the electromagnetic element.

A preferred embodiment of this invention is described below with reference to the attached drawings.

DETAILED DESCRIPTION OF THE INVENTION

Figure 1:
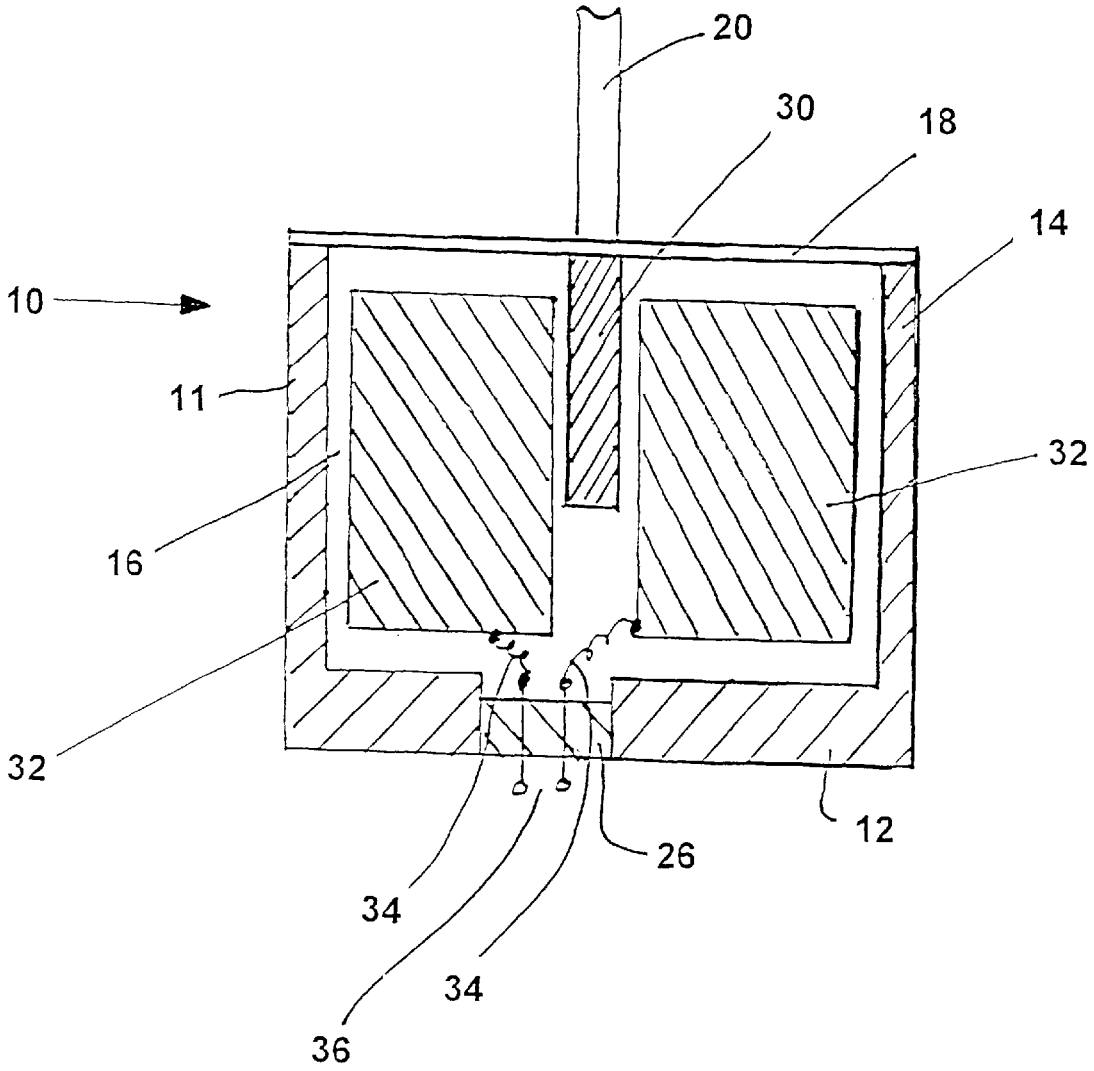
FIG. 1 shows a sectional view of a transducer in accordance with the preferred embodiment of the present invention.
Figure 2:
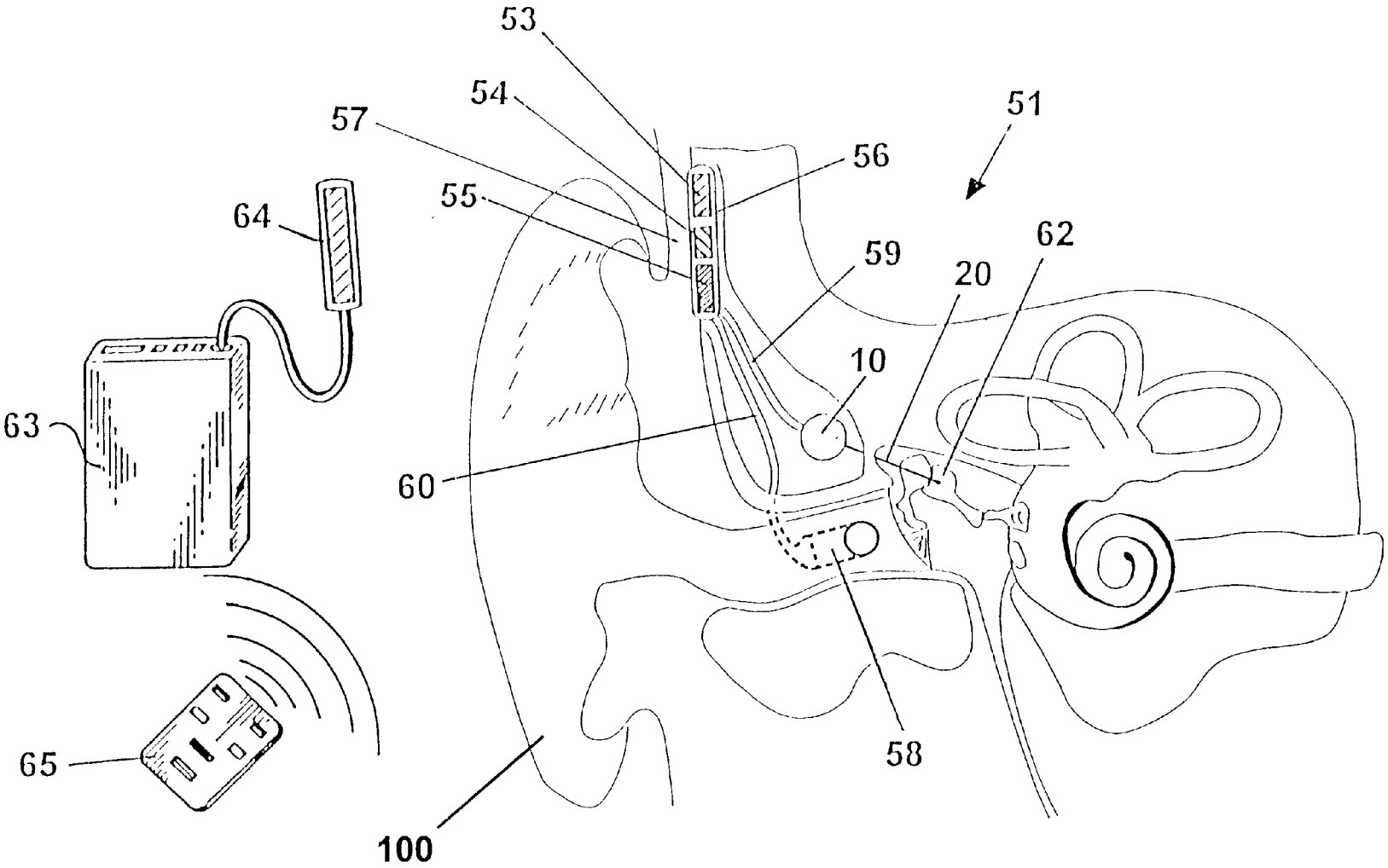
FIG. 2 shows a sectional view of a human ear with an implanted hearing aid including a transducer in accordance with the present invention as illustrated in FIG. 1.

FIG. 1 shows an implantable transducer arrangement for a hearing aid for direct mechanical excitation of the middle or inner ear including an electromechanical transducer 10 in accordance with the preferred embodiment of the present invention. A detector, such as a microphone 58 (as shown in FIG. 2), may be provided and is preferably implanted to receive the sound. As FIG. 1 illustrates, the transducer 10 is equipped with a hermetically sealed, biocompatible cylindrical housing 14. The housing 14 is preferably made of metal, for example, titanium, niobium, tantalum, iridium or their alloys and is filled with an inert gas 16. The housing 14 has one peripheral wall 11 and two circular end walls 12 and 18 which are substantially perpendicular to the peripheral wall 11. In this embodiment, the end wall 12 may be integrally joined to the peripheral wall 11 of the housing. The end wall 18 of the housing 14 is made as a thin vibratory membrane 18 with a coupling element 20 fixedly attached to the side of the vibratory membrane 18 outside the housing 14. The coupling element 20 is preferably welded or cemented to the center of the vibratory membrane 18 and provides mechanical vibrational coupling to the middle ear ossicle or directly to the inner ear.

As also illustrated in FIG. 1, the electromagnet arrangement includes an electromagnetic component 32 and a vibratory component 30. The vibratory component 30 is provided at the center of the vibratory membrane 18 on the side of the vibratory membrane 18 inside the housing 14. The vibratory component 30 may be a pin or rod shaped permanent magnet and may be attached to the vibratory membrane 18 by an adhesive or other attaching means. The electromagnetic component 32 is also provided within the housing 14 and is permanently fixed, for example, by cementing it to the housing 14. The electromagnetic component 32 may be a coil or a ring coil with a central opening so that the vibratory component 30 may be positioned and displaced within the central opening of the electromagnetic component 32 as illustrated in FIG. 1. In addition, an electrically insulating, hermetic penetration 26 is provided on the end wall 12 so that the terminals 36, which are electrically connected to the electromagnetic component 32 by wires 34, may be routed out of the housing 14.

Excitation of the electromagnetic component 32 by application of an AC voltage to the terminals 36 causes a displacement of the vibratory component 30 relative to the housing-mounted electromagnetic component 32 thereby causing deflection of the vibratory membrane 18. As previously noted, the electromagnetic component 32 may be a ring coil and the vibratory component 30 may be a permanent pin magnet. The deflection of the vibratory membrane 18 is transmitted via the coupling element 20 to the middle-ear ossicle or directly to the inner ear. The coupling element 20 may be made as a connecting rod and can be connected to the ossicular chain, for example, by a thin wire or hollow wire clip or a clip of carbon fiber-reinforced composite. Suitable arrangements of this type are described in commonly owned, co-pending U.S. Pat. application Ser. No. 09/042,805 which is hereby incorporated by reference.

FIG. 2 shows an implanted hearing aid 51 which is equipped with a transducer 10 of the above described type as implanted in a human ear 100. The hearing aid 51 includes a battery unit 53, a charging reception coil 54, and an electronic module 55. These components are accommodated in a hermetically sealed housing 56 which can be implanted in the mastoid region 57. The transducer 10 and a microphone 58 are connected via wires 59 and 60 to the electronic module 55. The coupling element 20 (illustrated penetrating through an opening on the incus) is coupled to the ossicular chain 62. The portable charging unit 63 includes a charging transmission coil 64 which can be inductively coupled to the charging reception coil 54 for transcutaneous charging of the battery unit 53. A remote control unit 65 may also be provided. A hearing aid of this general type is exemplified in U.S. Pat. No. 5,277,694 and therefore, need not be discussed in further detail here.

While the preferred embodiment of the present invention has been described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. Transducer for an at least partially implantable hearing aid for providing direct mechanical excitation of at least one of a middle ear and an inner ear comprising, a housing for fixed mounting at an implantation site and a coupling element that is moveable with respect to said housing for transmitting vibration to said at least one of a middle ear and an inner ear, wherein said housing accommodates an electromagnetic component fixed relative to said housing and a vibratory component mechanically connected to said coupling element in a manner that vibration of said vibratory component is transferred to said coupling element; wherein a wall of said housing is a vibratory membrane with said vibratory component attached to a side of said vibratory membrane inside said housing and wherein said coupling element is connected to a side of said vibratory membrane outside said housing.

2. Transducer of claim 1, wherein said housing is hermetically sealed and biocompatible.

3. Transducer of claim 1, wherein said housing is substantially cylindrical with one peripheral wall, a first end wall and a second end wall, said first end wall being substantially parallel to said second end wall.

4. Transducer of claim 3, wherein one of said first end wall and said second end wall of said housing forms said vibratory membrane.

5. Transducer of claim 4, wherein one of said first end wall and said second end wall of said housing is joined integrally to said peripheral wall of said housing.

6. Transducer of claim 4, wherein said vibratory component is attached substantially centrally at a center of said vibratory membrane.

7. Transducer of claim 4, wherein said coupling element is attached substantially centrally at a center of said vibratory membrane.

8. Transducer of claim 1, further comprising a means for operating said electromagnetic element to vibrate said vibratory component.

9. Transducer of claim 8, wherein said vibratory component is a permanent magnet and said electromagnetic component is a coil.

10. Transducer of claim 9, wherein said permanent magnet is a magnetic pin and said coil is a ring coil with a central opening, said magnetic pin being positioned within said central opening.

* * * * *